United States Patent [19]

Spinosa et al.

[11] 4,305,438

[45] Dec. 15, 1981

[54] FILLER VALVE ADAPTER TOOL KIT

[75] Inventors: Dominic J. Spinosa, Wantagh; Frank Knoll, Huntington Station, both of N.Y.

[73] Assignee: East/West Industries, Inc., Farmingdale, N.Y.

[21] Appl. No.: 108,410

[22] Filed: Dec. 31, 1979

[51] Int. Cl.[3] ..... B65B 3/04; B25B 13/06

[52] U.S. Cl. ..... 141/98; 81/121 B; 81/125.1; 285/39; 285/158; 285/386

[58] Field of Search ..... 81/121 A, 121 B, 125.1; 141/1, 2, 3, 18, 98, 231, 311 R, 382–386, 392; 285/39, 158, 386

[56] References Cited

U.S. PATENT DOCUMENTS

| | | | |
|---|---|---|---|
| 1,948,725 | 2/1934 | McClintock | 285/386 X |
| 2,015,613 | 9/1935 | Baumgarten | 81/125.1 X |
| 2,733,937 | 2/1956 | Mowrer | 285/39 |
| 3,992,043 | 11/1976 | Whitley | 285/39 |

*Primary Examiner*—Frederick R. Schmidt
*Attorney, Agent, or Firm*—Leonard W. Suroff

[57] ABSTRACT

The kit of the present invention is for use in the refilling within a survival unit of a gaseous supply tank through a filler valve having a threaded stem adjacent the free end thereof and a gripping surface on the filler valve. The gas is generally oxygen although other gas may be supplied. The kit includes an adapter to provide coupling relationship with the threaded stem of the filler valve so as to permit a flow of oxygen into the supply tank such that refilling thereof may take place without removal of the supply tank from the survival kit. The adapter includes an elongated member with an aperture extending therethrough and is adapted to mate with the filler valve in sealing engagement therewith so as to permit gas flowing through the aperture to enter the filler valve. The adapter further includes a holder with a bore extending axially therethrough and the elongated member extends axially through the aperture. A gripping section is provided on the adapter so as to obtain a coupling to the threaded stem such that rotation of the holder by means of the gripping section obtains abutting sealing engagement between the member and the filler valve. A wrench adapted to be used in conjunction with the adapter is provided as part of the kit. The wrench includes a socket for enclosing the gripping surface to provide retention of the filler valve in fixed position as the member is releasably coupled to the filler valve.

9 Claims, 9 Drawing Figures

FIG. 2
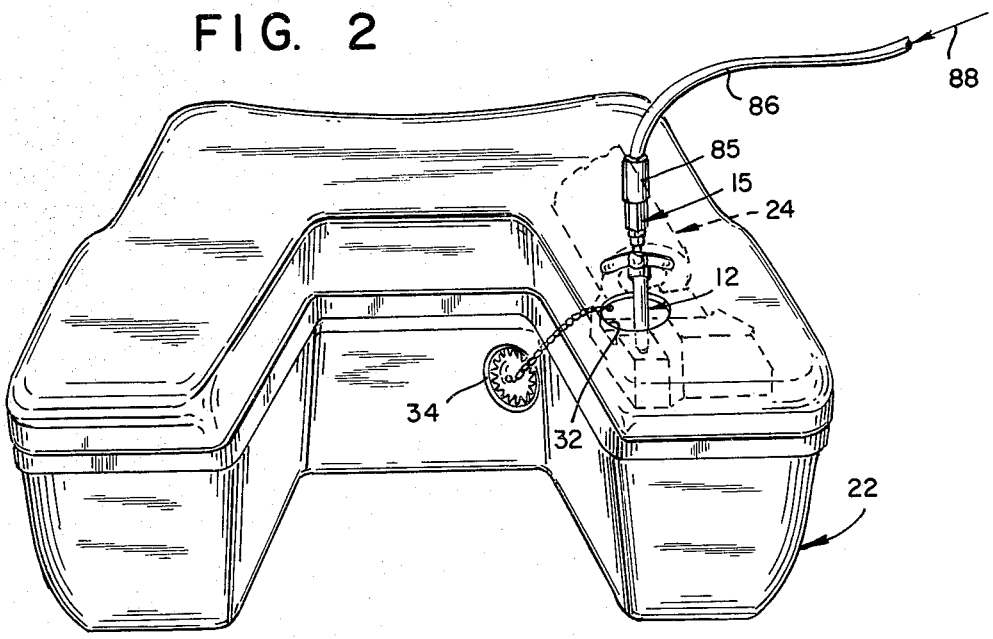
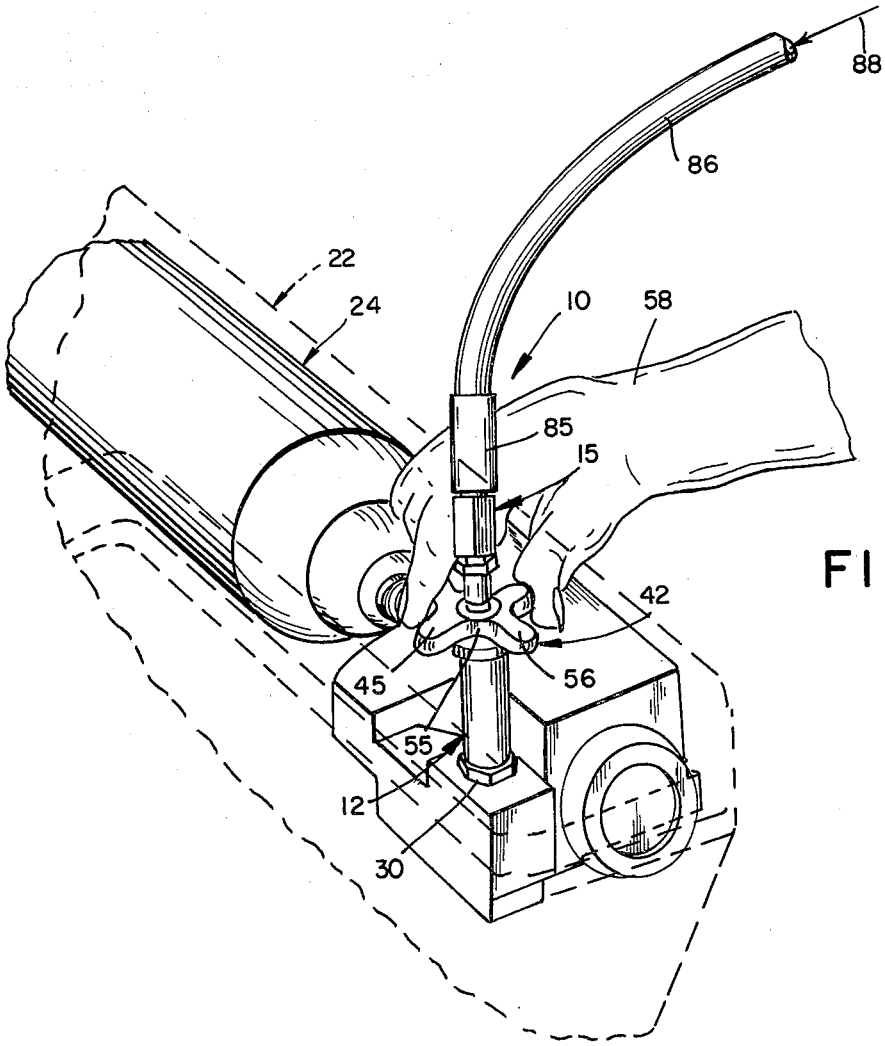
FIG. 3

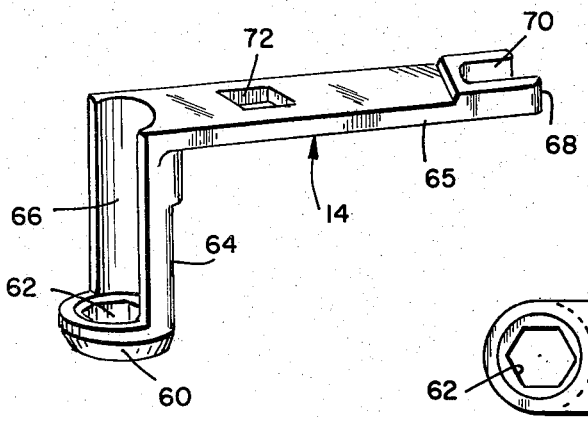
FIG. 6
FIG. 7
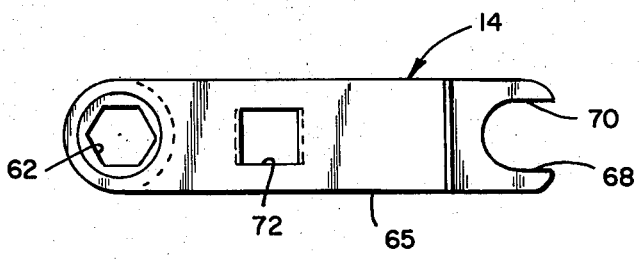
FIG. 8
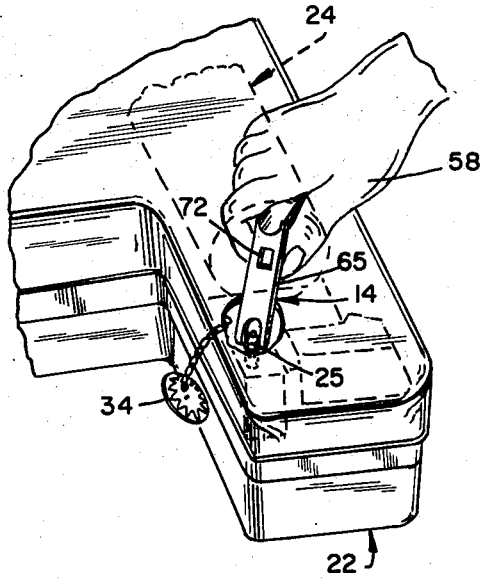
FIG. 9
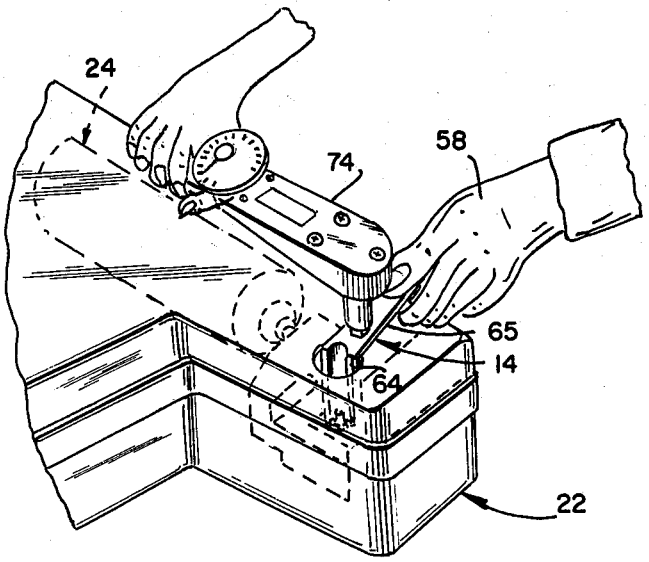

FILLER VALVE ADAPTER TOOL KIT

BACKGROUND OF THE INVENTION

The invention relates generally to survival units as contained in aircraft and more particularly to a kit for use in the refilling of the oxygen in the supply tank thereof.

The refilling of the oxygen supply tank is required from time to time and the kit of the present invention permits this process to be accomplished in a safe manner without the need to remove the survival kit from the aircraft, or other location, as well as the supply tank from the aircraft. The refilling cycle can be dangerous since oxygen is easily ignited and accidents have previously occurred. It has now been discovered, that by the use of the kit of the present invention, that a safe and efficient refilling process can be readily conducted.

OBJECTS OF THE INVENTION

An object of the invention is to provide an improved kit which is easily and quickly assembled and used, and thereafter disassembled and stored in place.

Another object of the present invention is to provide an installation kit that permits the component parts thereof to be readily fabricated from a metallic material and used for its requisite purpose.

Other objects and advantageous of the present invention will become apparent as the disclosure proceeds.

SUMMARY OF THE INVENTION

The kit of the present invention is for use in the refilling within a survival unit of a gaseous supply tank through a filler valve having a threaded stem adjacent the free end thereof and a gripping surface on the filler valve. The gas is generally oxygen although other gas may be supplied. The supply tank, by use of the kit of the present invention, can remain within the survival unit, and be refilled without removal therefrom.

The kit includes an adapter to provide coupling relationship with the threaded stem of the filler valve so as to permit a flow of oxygen into the supply tank such that refilling thereof may take place without removal of the supply tank. The adapter includes an elongated member having a front end and a spaced apart rear end with an aperture extending between the front end and spaced apart rear end. The front end is adapted to mate with the free end of the filler valve in sealing engagement therewith so as to permit gas flowing through the aperture to enter the filler valve. The rear end of the elongated member has a threaded portion contained thereon such that oxygen or the like may pass through the aperture.

The adapter further includes a holder having a bottom end and a top end with a bore extending axially therethrough between the bottom end and the top end thereof. The elongated member extends axially through the aperture, with the holder having a chamber which is threaded and an elongated front section having an outer contoured surface, both of which extend from the bottom end. The threaded chamber mates with the threaded stem of the filler valve. A gripping section is provided on the adapter adjacent the top end of the holder so as to obtain a coupling of the threaded chamber with the threaded stem such that rotation of the holder by means of the gripping section obtains abutting sealing engagement between the front end of the member and the free end of the filler valve.

A wrench adapted to be used in conjunction with the adapter is provided as part of the kit. The wrench includes a socket for enclosing the gripping surface to provide retention of the filler valve in fixed position as the member is releasably coupled to the filler valve. A rib is coupled to the socket and extending upwardly therefrom, with a handle extending outwardly from the rib for retaining the wrench in fixed position during use of the adapter. The rib includes a mating surface extending between the socket and the handle. The mating surface extends in vertically spaced relationship to the contoured surface so as to permit the holder to be freely rotatable relative to the wrench as the adapter is assembled and disassembled with respect to the filler valve and the elongated member moves longitudinally relative to the holder as the holder moves into assembled relationship with the filler valve.

The kit is so designed such that the handle on the wrench has a distal end with a slot therein of a size to receive the gripping surface of the filler valve for use of the wrench independently of the adapter for loosening or tightening of the adapter valve relative to the supply tank. In this manner any tightening of the filler valve may be accomplished using the slot in the handle. The handle also has an opening therein for receiving a torquing instrument so as to obtain controlled tighting of the filler valve relative to the supply tank using the socket.

The member of the holder includes a beveled edge at the front end, and the gripping section being coupled to the front section and having a plurality of projections extending radially therefrom so as to facilitate gripping of same for rotation of the holder.

The contoured surface may have a circular configuration, and the mating surface may have a corresponding circular configuration. In addition the handle may be inclined relative to the rib. The member includes a front head adjacent the front end and is adapted to extend within the chamber so as to confine the member relative to the holder at one end thereof, and a rear head having a greater cross-section than the bore so as to retain the member in relative fixed position relative to the holder. The member also has a threaded section adjacent to the rear end thereof.

The kit further includes a coupling element for securement to the member by means of the threaded section and having a passageway extending axially therethrough for mating with the aperture in the member so as to permit the passage of oxygen or the like therethrough in refilling of the supply tank.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 2 is a perspective view of a survival unit having a supply tank therein with certain components of the kit in assembled position therewith;

FIG. 3 is an enlarged fragmentary perspective view illustrating the supply tank contained within the survival unit and adapted to be refilled by use of the kit of the present invention;

FIG. 6 is a perspective view of the wrench forming part of the kit of the present invention;

FIG. 7 is a top plan view of the wrench illustrated in FIG. 6;

FIG. 8 is a perspective view of the survival unit using one end of the wrench; and FIG. 9 is a view similar to FIG. 8 with a torquing instrument being used on the wrench.

DETAILED DESCRIPTION OF THE DRAWINGS

Figure 1:
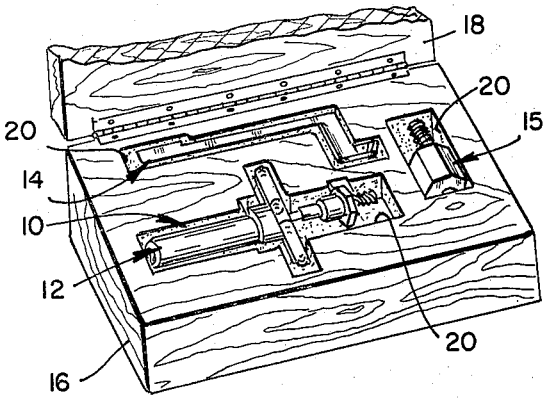
FIG. 1 is a perspective view of the kit in accordance with the present invention contained in a receptacle for use during storage thereof.

Referring to the drawings there is illustrated in FIGS. 1–9 an oxygen filler valve kit 10 consisting of an adapter 12, a wrench 14 and a coupling element 15 that may be stored in a receptacle 16 having a cover 18 associated therewith. The receptacle 16, as illustrated in FIG. 1, may include a seat or recess 20 into which the respective components, the adapter 12, wrench 14 and coupling element may be stored prior to use thereof.

The kit 10 is used in conjunction with a survival unit 22, that is generally found in an aircraft, and includes a plurality of items well known in the art. One of such items is a gaseous supply tank 24, generally containing oxygen, and the supply tank 24 is to be refilled from time to time as required. The supply tank 24 has a filler valve 25 extending therefrom which includes a threaded stem 26 adjacent the free end 28 thereof. The filler valve 25 includes a gripping surface 30 which may be in the form of a hexagon.

As illustrated in FIGS, 2, 4, 8 and 9, the supply tank 24 is illustrated to extend within the survival unit 22, with the filler valve 25 being accessible through the opening 32 which has a closure 34 associated with it. The supply tank 24 is fixedly mounted in the survival unit 22 and the kit 10 permits the filler valve 25 to be reached for transmitting therethrough the gas required. The filler valve 25 automatically opens under pressure to permit the gas to flow therein.

The adapter 12 provides coupling relationship with the threaded stem 26 of the filler valve 25 so as to permit a flow of oxygen into the supply tank 24 such that refilling thereof may take place without removal of the supply tank 24. The adapter 12 includes an elongated member 34 having a front end 35 and a spaced apart rear end 36 with an aperture 38 extending between the front end 35 and spaced apart rear end 36. The front end 35 is adapted to mate with the free end 28 of the filler valve 25 in sealing engagement therewith so as to permit gas flowing through the aperture 38 to enter the filler valve 25. The rear end 36 of the elongated member 34 has a threaded portion or section 40 contained thereon for securement to the coupling element 15 such that oxygen or the like may pass through the aperture 38.

The adapter 12 further includes a holder 42 having a bottom end 44 and a top end 45 with a bore 46 extending axially therethrough between the bottom end 44 and the top end 45 thereof. The elongated member 34 extends axially through the aperture 38, with the holder 42 having a chamber 48 which is threaded with threads 50. The chamber 48 extends inwardly from the bottom end 44. An elongated front section 52 is provided having a mating or outer contoured surface 54 which extends from the bottom end 44. The threaded chamber 48 mates with the threaded stem 26 of the filler valve 25. A gripping section 55 is provided on the adapter 12 adjacent the top end 45 of the holder 42 so as to obtain a coupling of the threaded chamber 48 with the threaded stem 26 such that rotation of the holder 42 by means of the gripping section 55 obtains abutting sealing engagement between the front end 35 of the member and the free end 28 of the filler valve 25. The gripping section 55 may include a plurality of prongs or projections 56.

The projections 56 permits the hand 58 of the user of the kit 10, to rotate the holder 42 such that the in refilling of the supply tank 24 proper positionment and coupling of the elongated member 34 is obtained.

Figure 4:
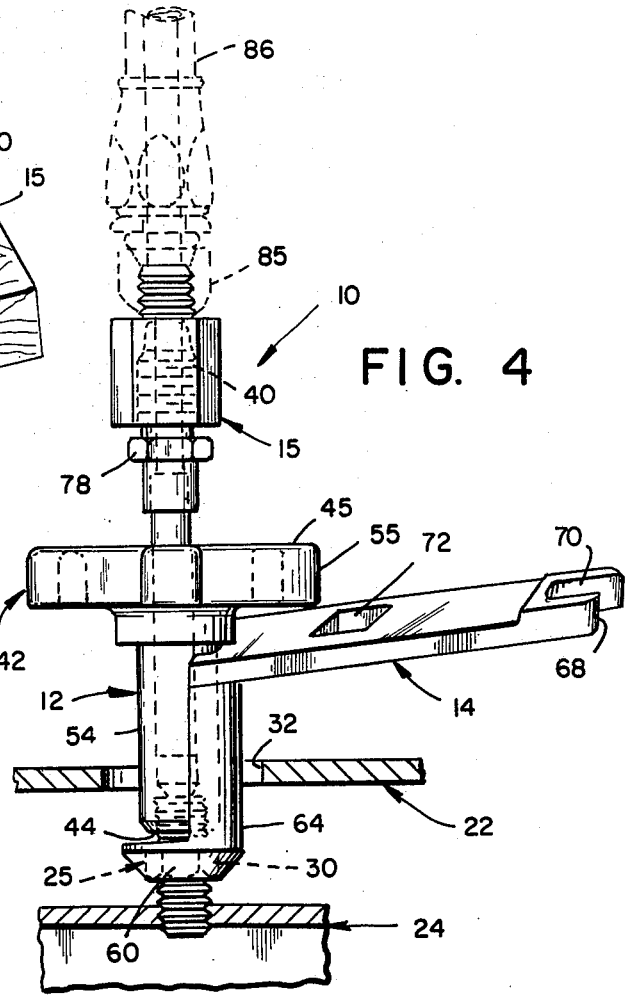
FIG. 4 is a side view, partly in section, illustrating the kit components in assembled position to the supply tank.

The wrench 14 is adapted to be used in conjunction with the adapter 12 illustrated in FIG. 4. The wrench 14 includes a socket 60 with a socket opening 62 for enclosing the gripping surface 30 to provide retention of the filler valve 25 in fixed position as the member 34 is releasably coupled to the filler valve 25. A rib 64 is coupled to the socket 60 and extends upwardly therefrom, with a handle 65 extending outwardly from the rib 64 for retaining, the wrench 14 in fixed position during use of the adapter 12 or independent use of the wrench 14 as illustrated in FIGS. 8 and 9. The rib 64 includes a mating surface 66 extending between the socket 60 and the handle 65. The mating surface 66 extends in vertically spaced relationship to the contoured surface 54 so as to permit the holder 42 to be freely rotatable relative to the wrench 14 as the adapter 12 is assembled and disassembled with respect to the filler valve 25 and the enlongated member 34 moves longitudinally relative to the holder 42 as the holder 42 moves into assembled relationship with the filler valve 25.

The kit 10 is so designed such that the handle 65 on the wrench 14 has a distal end 68 with a slot 70 therein of a size to receive the gripping surface 30 of the filler valve 25 for use of the wrench 14 independently of the adapter 12 for loosening or tightening of the adapter valve 25 relative to the supply tank 24. In this manner any tightening of the filler valve 25 may be accomplished using the slot 70 in the handle 65. The handle 65 also has an opening 72 therein for receiving a torquing instrument 74 so as to obtain controlled tightening of the filler valve 25 relative to the supply tank 24 using the socket 60.

The wrench 14 may be used to check that the filler valve 25 is tightened to the requiste torque. The wrench 14 as illustrated in FIG. 8 may be used at its distal end 68 with the slot 70 enclosing the gripping surface 30 for removal of the filler valve 25 for maintenance or other purposes. The socket 60 is positioned and permits maximum accessibility to the filler valve 25 and can be used in very close quarters. The primary use of the wrench 14 is to hold the filler valve 25 in place when the adapter 12 is used. If this is not done, the filler valve 25 could inadvertently turn out and cause an explosion or fire.

The member 34 of the holder 42 includes a beveled edge 75 at the front end 35 which permits self-sealing alignment to the filler valve 25. The gripping section 55 being coupled to the front section 52 and having the plurality of projections 56 extending radially therefrom so as to facilitate gripping of same for rotation of the holder 42 as the beveled edge 75 is brought into sealing position with the adapter valve 25.

Figure 5:
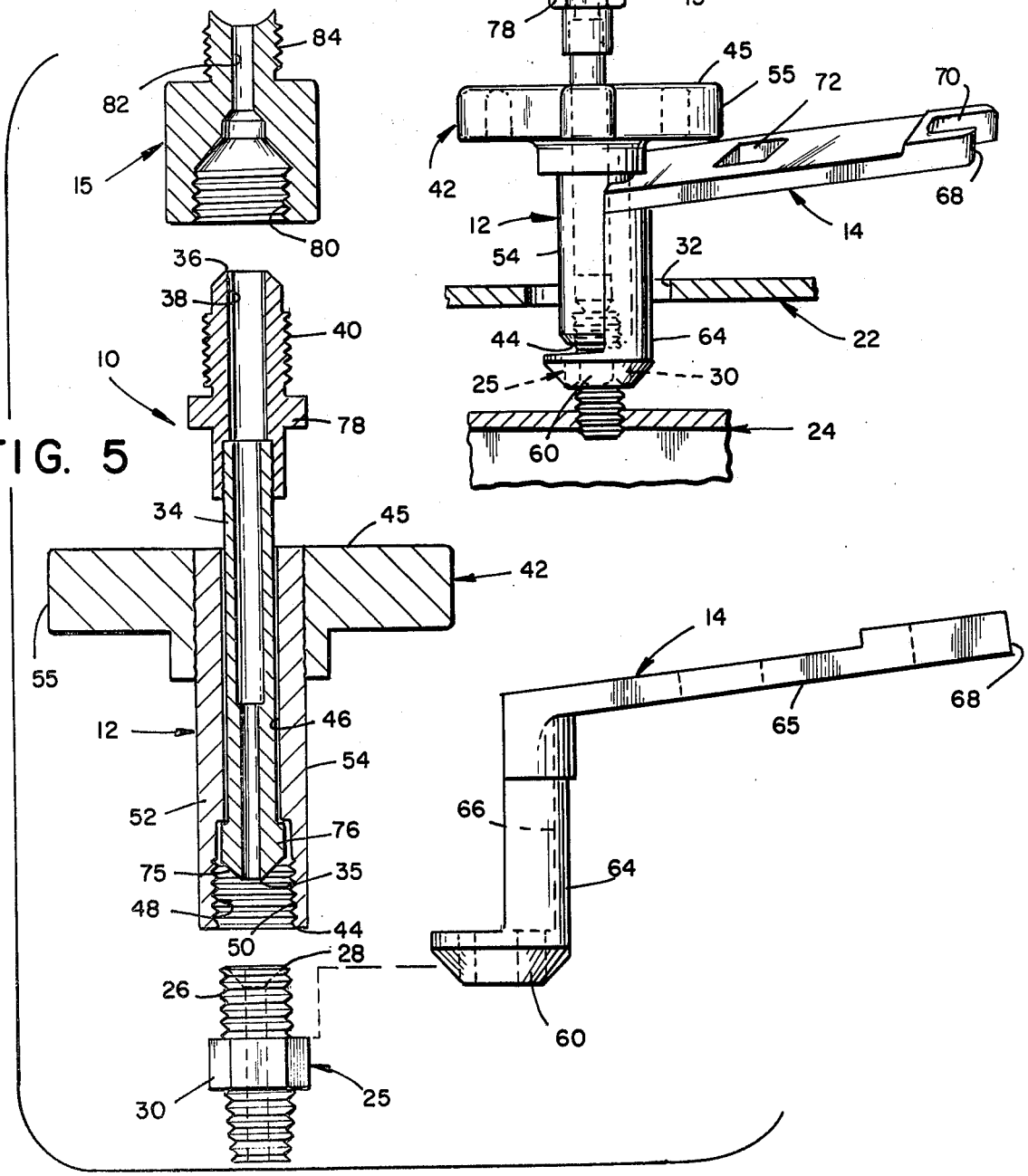
FIG. 5 is a view similar to FIG. 4, in cross-section, illustrating the respective components of the kit.

The contoured surface 54 may have a circular configuration, and the mating surface 66 may have a corresponding circular configuration. In addition the handle 65 may be inclined relative to the rib 64. The member 34 includes a front head 76, as illustrated in FIG. 5, adjacent the front end 35 and is adapted to extend within the chamber 48 so as to confine the member 34 relative to the holder 42 at one end thereof, and a rear head 78 having a greater cross-section than the bore 46 so as to retain the member 34 in relative fixed position relative to the holder 42. The member 34 also has the threaded section 40 adjacent to the rear end 36 thereof.

The kit 10 further includes the coupling element 15 for securement to the member 34 by means of the threaded section 80 to mate with threaded section 40. The coupling element 15 has a passageway 82 extending axially therethrough for mating with the aperture 38 in the member 34 so as to permit the passage of oxygen or the like therethrough in refilling of the supply tank 24.

The coupling element 15 includes an outer threaded section 84 that is coupled to a fitting 85, as illustrated in FIG. 4, having a supply hose 86 connected thereto in a conventional manner. The supply of oxygen or other gas enters in the direction of arrow 88 to refill the supply tank 24.

Accordingly the wrench 14 is primarily used to hold the filler valve 25 in place when the adapter 12 is used. The coupling element 15 provides for the hose 86 to be attached thereto for quick filling of the supply tank 24 from a cart while on the flight line for aircraft uses. As illustrated in FIG. 4 the components of the kit 10 are used in assembled relationship with each other during the refilling cycle. It will be noted that the holder 42 is free to rotate when the gripping section is rotated during the assembly and disassembly cycle. The components of the kit may be fabricated from a metallic material such as stainless steel. The wrench 14 is also independently functional as illustrated in FIGS. 8 and 9 to perform other needs as related to the maintenance of the survival unit 22.

For example as illustrated in FIG. 9 the torquing instrument 74 fits within the opening 72 in the rib 65 for tightening of the filler valve 25. The wrench 14 is readily gripped by the users hand 58 as required. The components of the kit 10 are readily stored within the receptacle 16 when not in use and easily assembled when required.

Although an illustrative embodiment of the invention has been described in detail herein with reference to the accompanying drawing, it is to be understood that the invention is not limited to the precise embodiment, and that various changes and modifications may be effected therein without departing from the scope or spirit of the invention, except in the appended claims.

What is claimed is:

1. A kit for use in the refilling of a gaseous supply tank disposed beneath a surface within a survival unit through a filler valve having a threaded stem adjacent the free end thereof and a gripping surface, with oxygen or other gas, said kit comprising:

A. an adapter to provide coupling relationship with said threaded stem of said filler valve so as to permit a flow of oxygen into said supply tank such that refilling thereof may take place, said adapter including;

(1) an elongated member having a front end and a spaced apart rear end with an aperture extending between said front end and spaced apart rear end, said front end extending beneath said surface and adapted to mate with said free end of said filler valve in sealing engagement therewith and said rear end having a threaded portion contained thereon such that oxygen or the like may pass through said aperture, (2) an elongated holder having a bottom end and a top end for extending beneath said kit surface with a bore extending axially therethrough between said bottom end and said top end thereof, said elongated member extending axially through an axial aperture provided in said holder, said holder having a chamber which is threaded and an elongated front section having an outer contoured surface, both extending from said bottom end, said threaded chamber adapted to mate with said threaded stem of said filler valve, and a gripping section adjacent said top end of said holder so as to obtain a coupling of said threaded chamber with said threaded stem such that rotation of said holder by means of said gripping section obtains abutting sealing engagement between said front end of said member and said free end of said filler valve; and B. a wrench adapted to be used in conjunction with said adapter, said wrench including;

(1) a socket for enclosing said gripping surface and extending beneath said kit surface to provide retention of said filler valve in fixed position as said member is releasably coupled to said filler valve, (2) a rib coupled to said socket and extending upwardly therefrom, (3) a handle extending outwardly from said rib for retaining said wrench in fixed position during use of said adapter, and (4) said rib includes a mating surface extending between said socket and said handle, said mating surface extending in vertically spaced relationship to said contoured surface so as to permit said holder to be freely rotatable relative to said wrench as said adapter is assembled and disassembled with respect to said filler valve and said elongated member moves longitudinally relative to said holder as said holder moves into assembled relationship with said filler valve, and C. said member including;

(1) a front head adjacent said front end and adapted to extend within said chamber so as to confine said member relative to said holder at one end thereof, and (2) a rear head having a greater cross-section than said bore so as to retain said member in relative fixed position relative to said holder.

2. The kit of claim 1, wherein said handle on said wrench has a distal end with a slot therein of a size to receive said gripping surface of said filler valve for use of said wrench independently of said adapter for loosening or tightening of said adapter valve relative to said supply tank.

3. The kit of claim 2, wherein said handle has an opening therein for receiving a torquing instrument so as to obtain controlled tightening of said filler valve relative to said supply tank.

4. The kit of claim 1, wherein said member includes a beveled edge at said front end, and said holder gripping section being coupled to said front section and having a plurality of projections extending radially therefrom so as to facilitate gripping of same for rotation of said holder.

5. The kit of claim 1, and further including a case for storing of said adapter and said wrench prior to use thereof.

6. The kit of claim 1, wherein:

a. said contoured surface has a circular configuration, and b. said mating surface has a circular configuration.

7. The kit of claim 1, wherein said handle is inclined relative to said rib.

8. The kit of claim 1, wherein said member has a threaded section adjacent to said rear end thereof.

9. The kit of claim 1, including a coupling element for securement to said member by means of a threaded section and having a passageway extending axially therethrough for mating with said aperture in said member so as to permit the passage of oxygen or the like therethrough in refilling of the supply tank.

* * * * *